US009327926B2

(12) United States Patent
Chiba

(10) Patent No.: US 9,327,926 B2
(45) Date of Patent: May 3, 2016

(54) SHEET FEEDING APPARATUS AND IMAGE FORMING APPARATUS

(71) Applicant: CANON KABUSHIKI KAISHA, Tokyo (JP)

(72) Inventor: Yoshinao Chiba, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/688,075

(22) Filed: Apr. 16, 2015

(65) Prior Publication Data

US 2015/0307298 A1 Oct. 29, 2015

(30) Foreign Application Priority Data

Apr. 23, 2014 (JP) ..... 2014-089065
Apr. 7, 2015 (JP) ..... 2015-078413

(51) Int. Cl.
*B65H 1/04* (2006.01)
*B65H 1/26* (2006.01)

(52) U.S. Cl.
CPC ..... *B65H 1/266* (2013.01); *B65H 1/04* (2013.01); *B65H 2403/53* (2013.01); *B65H 2403/60* (2013.01); *B65H 2801/06* (2013.01)

(58) Field of Classification Search
CPC ..... B65H 1/266; B65H 1/26; B65H 1/04; G03G 15/6502
See application file for complete search history.

(56) References Cited

U.S. PATENT DOCUMENTS 8,408,535 B2 4/2013 Miki
8,651,477 B2 2/2014 Chiba
2011/0013973 A1* 1/2011 Kusumi ..... B65H 1/266 403/119
2013/0285317 A1* 10/2013 Ishikura ..... B65H 9/08 271/241
2015/0076764 A1 3/2015 Chiba et al.
2015/0115521 A1 4/2015 Ishida et al.
2015/0191322 A1 7/2015 Chiba

FOREIGN PATENT DOCUMENTS

JP 2007-070068 A 3/2007
JP 2011-037540 A 2/2011

* cited by examiner

*Primary Examiner* — Luis A Gonzalez
(74) *Attorney, Agent, or Firm* — Fitzpatrick, Cella, Harper & Scinto

(57) ABSTRACT

A sheet feeding apparatus includes an apparatus body, a sheet feed portion, a sheet storage portion, and a resistance unit. The resistance unit includes a link member that is pivoted by coming in contact with the apparatus body when the sheet storage portion is mounted on the apparatus body toward a feed position, and is configured such that a distance between a normal line, in an contact surface with the apparatus body, and a pivot center becomes longer as the sheet storage portion approaches the feed position, a linear type oil damper generating a resistance force through a linear operation in accordance with pivoting of the link member, and a transmitting portion that is provided between the link member and the linear type oil damper, linearly moves due to the pivoting of the link member, and transmits the pivoting of the link member to the linear type oil damper.

20 Claims, 10 Drawing Sheets

SHEET FEEDING APPARATUS AND IMAGE FORMING APPARATUS

BACKGROUND OF THE INVENTION

1. Field of the Invention

This disclosure relates to a sheet feeding apparatus and an image forming apparatus, and particularly, to a configuration for alleviating impact when mounting a sheet storage portion on an apparatus body.

2. Description of the Related Art

In the related art, in an image forming apparatus such as a copier and a printer, a sheet feeding apparatus for supplying a sheet to an image forming portion is provided. The sheet feeding apparatus includes a sheet feeding cassette which is provided in an image forming apparatus body (hereinafter, referred to as apparatus body) to be mountable and in which sheets are stored, and a feed roller that feeds the sheet stored in the sheet feeding cassette.

However, there is either no sheet stored in the sheet feeding cassette or the sheet must be stored changed to another sheet. In this case, the sheet feeding cassette is drawn from the apparatus body and a new sheet is stored, and then the sheet feeding cassette is inserted into the apparatus body again.

This work is performed by a user and at this time, if the user may insert the sheet feeding cassette with excessive force, the sheet feeding cassette is mounted on the apparatus body with great force.

In this case, when the sheet feeding cassette is mounted at a feed position to which the sheet can be fed by the feed roller, impact occurs and there is a concern that the sheets stored in the sheet feeding cassette will be shifted or a mounting failure of the sheet feeding cassette will be caused by the impact when mounting the sheet feeding cassette.

Therefore, in a sheet feeding apparatus described in JP-A-2007-70068, a take-in apparatus that automatically takes a sheet feeding cassette in a feed position if the sheet feeding cassette is inserted by a predetermined amount is provided such that the user does not insert the sheet feeding cassette with excessive force.

If such a take-in apparatus is provided, if the sheet feeding cassette is pushed to a position of several tens of mm in front of the feed position, thereafter, the sheet feeding cassette is taken in to the feed position by the take-in apparatus.

Furthermore, in a sheet feeding apparatus described in JP-A-2011-37540, in order to suppress a momentum of a sheet feeding cassette when a take-in apparatus takes a sheet feeding cassette in, a rotary damper is provided in the take-in apparatus.

However, in the sheet feeding apparatus described in JP-A-2011-37540, the momentum of the sheet feeding cassette suppressed by the rotary damper is generated by a take-in force that is generated by the take-in apparatus. Thus, if the momentum of the sheet feeding cassette is suppressed by the rotary damper, the speed of the sheet feeding cassette is assumed as a speed generated by the take-in force generated by the take-in apparatus.

Thus, if the user inserts the sheet feeding cassette which has momentum, since the insertion speed of the sheet feeding cassette due to the user is added to a speed of the sheet feeding cassette due to the take-in apparatus, deceleration of the sheet feeding cassette is insufficient due to a resistance force provided by the rotary damper. Moreover, if a damper torque exerting the resistance force is more powerful due to the user inserting the sheet feeding cassette with momentum, the take-in force generated by the take-in apparatus is required to be set to a size which can overcome the damper torque.

However, the take-in force of the take-in apparatus is a resistance force occurring when the user takes the sheet feeding cassette out. That is, if the damper torque is powerful enough to reduce the impact when mounting the sheet feeding cassette and the take-in force of the take-in apparatus is also great, operation force increases when the user takes the sheet feeding cassette out, and thereby operability decreases.

Furthermore, the rotary damper changes the resistance force depending on the speed of the sheet feeding cassette, but does not change the resistance force based on an insertion position of the sheet feeding cassette. Thus, if the damper torque is reduced so as not to sacrifice the operability of the user, a damper having a large stroke is required to suppress the impact when the sheet feeding cassette is mounted and the apparatus increases in size.

SUMMARY OF THE INVENTION

According to a first aspect of this disclosure, there is provided a sheet feeding apparatus including an apparatus body, a sheet feed portion feeding a sheet, a sheet storage portion in which sheets fed by the sheet feed portion are stored and which is provided in the apparatus body to be capable of being mounted and drawn, and a resistance unit that is provided on one of the sheet storage portion and the apparatus body, and applies a resistance force against the sheet storage portion while the sheet storage portion is being mounted toward a feed position to which the sheet is capable of being fed by the sheet feed portion. The resistance unit includes a link member that is pivoted by coming in contact with the other of the sheet storage portion and the apparatus body while the sheet storage portion is being mounted on the apparatus body toward the feed position, and is formed such that a distance between a normal line in an contact surface with the other of the sheet storage portion and the apparatus body and a pivot center becomes longer as the sheet storage portion approaches the feed position, a linear type oil damper generating the resistance force through a linear operation in accordance with the pivoting of the link member, and a transmitting member that is provided between the link member and the linear type oil damper, linearly moves due to the pivoting of the link member, and transmits the pivoting of the link member to the linear type oil damper.

According to a second aspect of this disclosure, there is provided a sheet feeding apparatus including an apparatus body, a sheet feed portion feeding a sheet, a sheet storage portion in which sheets fed by the sheet feed portion are stored and which is provided in the apparatus body to be capable of being mounted and drawn, and a resistance unit applying a resistance force to the sheet storage portion while the sheet storage portion is being mounted toward a feed position to which the sheet is capable of being fed by the sheet feed portion. The resistance unit reduces the resistance force as the sheet storage portion approaches the feed position from a start position in which the sheet storage portion starts to receive the resistance force from the resistance unit.

Further features of the present invention will become apparent from the following description of exemplary embodiments (with reference to the attached drawings).

DESCRIPTION OF THE EMBODIMENTS

Figure 1:
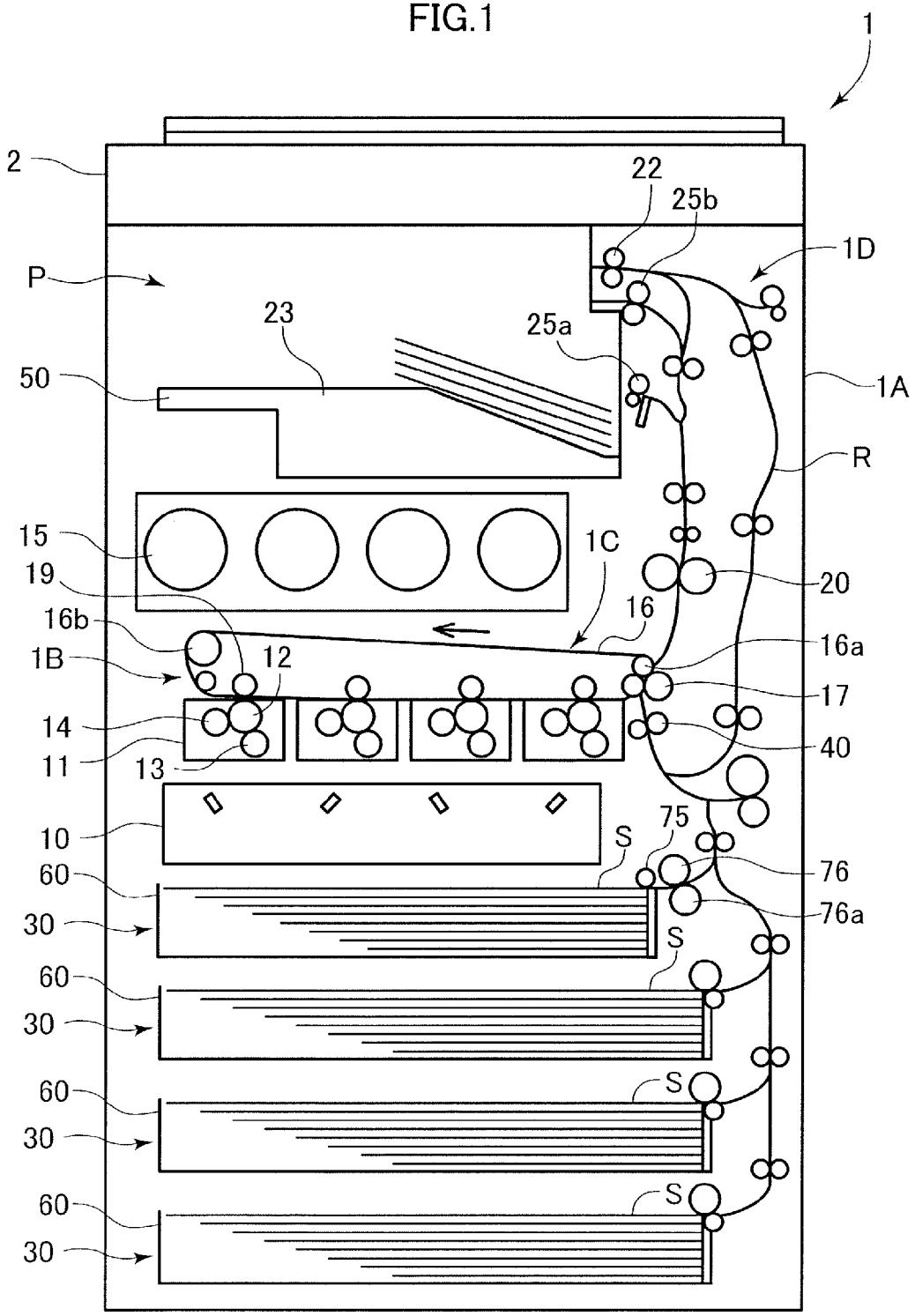
FIG. 1 is a view illustrating a schematic configuration of a full-color laser printer that is an example of an image forming apparatus including a sheet feeding apparatus according to an embodiment of this disclosure.

Hereinafter, embodiments of this disclosure will be described in detail with reference to the drawings. FIG. 1 is a view illustrating a schematic configuration of a full-color laser printer that is an example of an image forming apparatus according to an embodiment of this disclosure.

In FIG. 1, reference numeral 1 is a full-color laser printer (hereinafter, referred to as printer), reference numeral 1A is a printer body that is an image forming apparatus body, and reference numeral 1B is an image forming portion that forms an image on a sheet. Reference numeral 2 is an image reading apparatus that is substantially horizontally disposed above the printer body 1A. A discharge space P for discharging the sheet is formed between the image reading apparatus 2 and the printer body 1A. Reference numeral 30 is a sheet feeding apparatus that feeds the sheet S from a sheet feeding cassette 60 that is a sheet storage portion storing the sheet S.

The image forming portion 1B is a four-drum full-color system and includes a laser scanner 10 and four process cartridges 11 that form a toner image of four colors including yellow (Y), magenta (M), cyan (C), and black (K). Here, each process cartridge 11 includes a photoconductive drum 12, a charger 13 that is charging means, and a developer 14 that is developing means.

Furthermore, the image forming portion 1B includes an intermediate transfer unit 1C and a fixing portion 20 which are disposed above the process cartridge 11. Moreover, reference numeral 15 denotes a toner cartridge for supplying toner to the developer 14.

The intermediate transfer unit 1C includes an intermediate transfer belt 16 wound around a drive roller 16*a*, a tension roller 16*b*, and a primary transfer roller 19 provided inside of the intermediate transfer belt 16 and coming in contact with the intermediate transfer belt 16 at a position facing the photoconductive drum 12. Here, the intermediate transfer belt 16 is rotated by the drive roller 16*a* driven by a drive portion (not illustrated) in an arrow direction.

Then, each of the color toner images with negative polarity on the photoconductive drums is sequentially multi-transferred on the intermediate transfer belt 16 by the primary transfer roller 19. A secondary transfer roller that transfers the color image formed on the intermediate transfer belt to the sheet S is provided in a position facing the drive roller 16*a* of the intermediate transfer unit 1C.

Furthermore, the fixing portion 20 is disposed above the secondary transfer roller 17 and a first discharging roller pair 25*a*, and a second discharging roller pair 25*b*, and a two-side reversing portion 1D are disposed in a left upper portion of the fixing portion 20. The two-side reversing portion 1D is provided with a reverse roller pair 22 that is capable of forward and reverse rotation, a re-transport path R that re-transports the sheet on which the image is formed on one surface to the image forming portion 1B, and the like.

Next, an image forming operation of the printer 1 will be described. First, image information in a document is read by the image reading apparatus 2. The image information is transferred to the laser scanner 10 of the image forming portion 1B by being converted into an electrical signal after the image is processed. The laser scanner 10 sequentially exposes a surface of the photoconductive drum 12 in which the surface is uniformly charged to a predetermined polarity and potential with the charger 13 through the laser light based on a received electrical signal. Thus, electrostatic latent images in yellow, magenta, cyan, and black are sequentially formed respectively on the photoconductive drum of each process cartridge 11.

Thereafter, the electrostatic latent image is developed and visualized using each color toner, and each color toner image on each photoconductive drum is sequentially superimposed and transferred to the intermediate transfer belt 16 due to a primary transfer bias applied to the primary transfer roller 19. Thus, a full-color toner image is formed on the intermediate transfer belt 16.

Furthermore, the sheet S is delivered from the sheet feeding cassette 60 by a pickup roller 75 that is a sheet feed portion provided in a sheet feeding apparatus 30 parallel to a toner image forming operation. The delivered sheets S are transported to a registration roller pair 40 by being separated one by one by a separating unit constituted by a feed roller 76 and a retard roller 76*a*, and skew thereof is corrected by the registration roller pair 40.

After the skew of the sheet S is corrected by the registration roller pair 40, the sheet S is transported to the secondary transfer roller 17 by the registration roller pair 40 and the toner images on the intermediate transfer belt 16 are collectively transferred onto the sheet S by a secondary transfer bias applied to the secondary transfer roller 17. Next, the sheet S to which the toner image is transferred is transported to the fixing portion 20 and receives heat and pressure in the fixing portion 20. The color toners are respectively melted and mixed, and are fixed to the sheet S as the color image.

Thereafter, the sheet S to which the image is fixed is discharged to the discharge space P by first discharging roller pairs 25*a* and 25*b* provided on downstream of the fixing portion 20 and is stacked on a stacking portion 23 provided below the discharge space P. Moreover, when forming the image on two surfaces of the sheet S, after the image is fixed to a surface (first surface), the sheet S is transported to the re-transport path R by the reverse roller pair 22, and is transported to the image forming portion 1B again, thereby forming the image on a rear surface (second surface).

Figure 2:
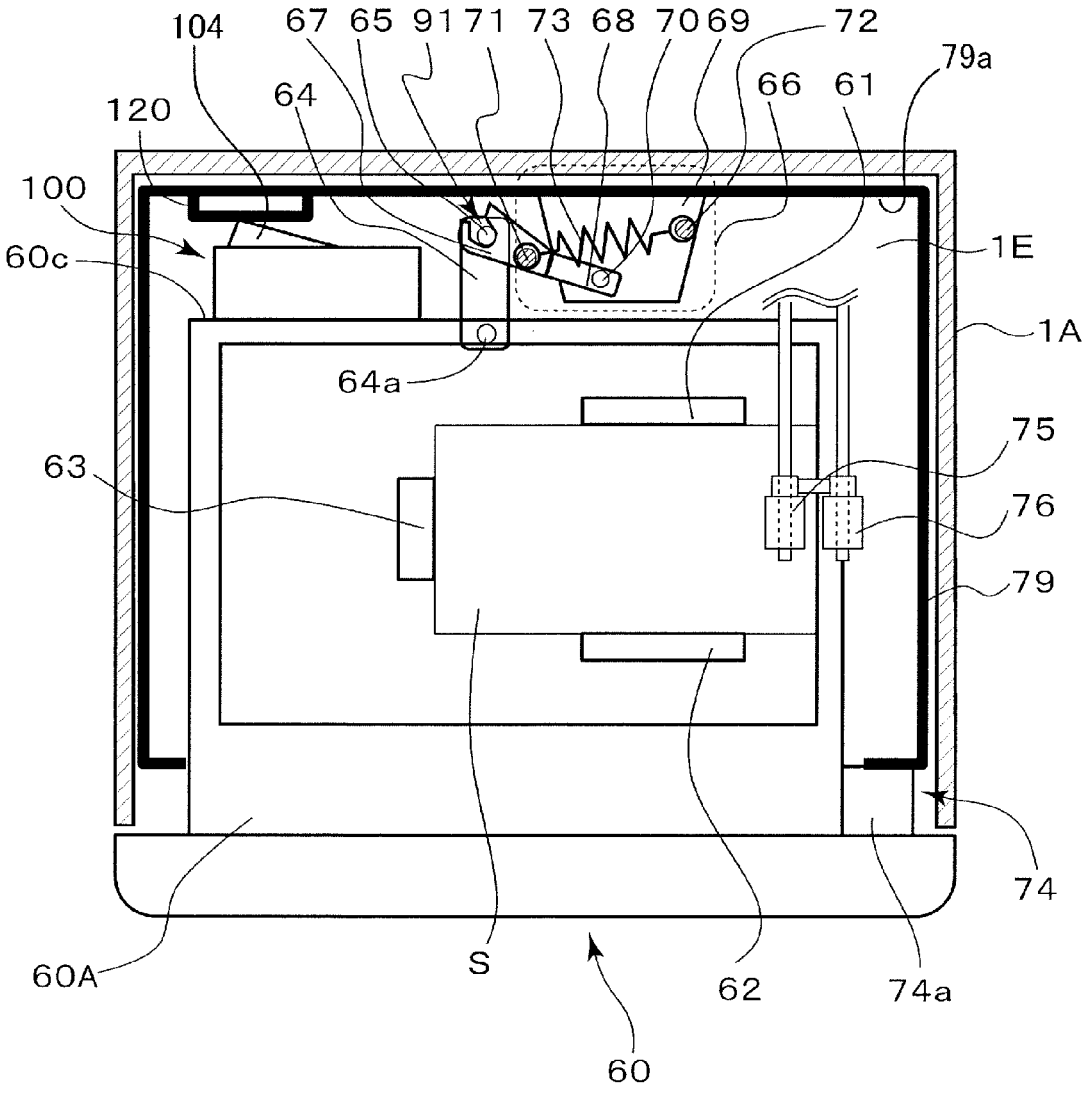
FIG. 2 is a plan view illustrating a configuration of a mounting portion and a sheet feeding cassette mounted on the mounting portion to be detachable of the full-color laser printer.

Here, the sheet feeding cassette 60 that is the sheet storage portion is detachably mounted on a mounting portion (mounting space) 1E illustrated in FIG. 2 formed below the printer body 1A configuring the sheet feeding apparatus body. As illustrated in FIG. 2, the sheet feeding cassette 60 is provided with a far side regulating plate 61 and a near side regulating plate 62 that regulate a position in a direction (depth direction) orthogonal to a sheet feeding direction of the sheet S.

Moreover, in the embodiment, the sheet feeding cassette 60 is inserted on a far side of the apparatus body 1A and is drawn from the near side of the apparatus body 1A. Furthermore, the sheet feeding cassette 60 is provided with a trailing end regulating plate 63 that regulates a position of a trailing end that is an upstream end in the sheet feeding direction of the sheet S. Furthermore, the sheet feeding cassette 60 is provided with an intermediate plate (not illustrated) on which the sheet is stacked and the position of the sheet stacked on the intermediate plate is regulated by the far side regulating plate 61, the near side regulating plate 62, and the trailing end regulating plate 63.

A swing arm 64 having a swing pin 65 at a distal end portion thereof is pivotably supported about a shaft 64*a* as a supporting point in a far side wall 60*c* of a sheet feeding cassette body 60A of the sheet feeding cassette 60. Furthermore, a take-in unit 66 that elastically takes the sheet feeding cassette 60 into the mounting portion 1E is disposed in a far side inner wall surface 79*a* of a body frame 79 configuring the mounting portion 1E. The take-in unit 66 is provided with a take-in unit base 69 fixed to the far side inner wall surface 79*a* and a take-in arm 68 in which a take-in hook 67 is provided at a distal end thereof and which is supported on the take-in unit base 69 to be pivotable in a clockwise direction about a supporting point 70.

A concaved portion 91 locking the swing pin 65 of the swing arm 64 is formed in the take-in hook 67 of the take-in arm 68. Furthermore, an arm pin 71 is provided between the take-in hook 67 and the supporting point 70 of the take-in arm 68. One end of a tension spring 73 (biasing member) is locked in a base pin 72 provided in the take-in unit base 69 and the other end of the tension spring 73 is locked in the arm pin 71. Then, the tension spring 73 functions as a toggle spring (toggle mechanism) and biases the take-in arm 68 so as to pivot about the supporting point 70.

Moreover, while taking out the sheet feeding cassette 60, the take-in arm 68 pivots about the supporting point 70 in a counterclockwise direction from a position illustrated in FIG. 2 in a pull-out direction while pushing against the tension spring 73 when the concaved portion 91 is locked in the swing pin 65. Thereafter, if the sheet feeding cassette 60 is pulled out further, the take-in arm 68 pivots to a standby position in which the locking of the swing pin 65 is released by the concaved portion 91.

The standby position is a position in which the swing pin 65 of the swing arm 64 provided in the sheet feeding cassette 60 is accepted in the concaved portion 91 of the take-in hook 67 of the take-in arm 68. Moreover, before pivoting to the standby position, if the take-in arm pivots by a predetermined amount and the sheet feeding cassette 60 is positioned in a predetermined position, a force pivoting the take-in arm 68 in the counterclockwise direction due to the tension spring 73 is applied to the take-in arm 68. After the take-in arm 68 is moved to the standby position by the force, the take-in arm 68 comes in contact with a stopper (not illustrated) and is stopped.

On the other hand, when mounting the sheet feeding cassette 60 on the printer body 1A, if the sheet feeding cassette 60 is inserted into the mounting portion 1E, first, the swing pin 65 of the swing arm 64 provided in the sheet feeding cassette 60 is taken in to the concaved portion 91 of the take-in hook 67 of the take-in arm 68 that is in the standby position. Thereafter, if the sheet feeding cassette 60 is further pressed, the take-in arm 68 is pressed on the far side by the swing pin 65 and the take-in hook 67.

Thus, the take-in arm 68 pivots in the clockwise direction about the supporting point 70 while pushing against the tension spring 73. Thereafter, if the take-in arm 68 pivots to a predetermined position (neutral position of the toggle mechanism), the take-in arm 68 pivots in the clockwise direction. Then, a biasing force is applied thereto by the tension spring 73.

Then, as described above, in the process during which the take-in arm 68 pivots in the clockwise direction, the concaved portion 91 of the take-in hook 67 is locked in the swing pin 65. As a result, if the take-in arm 68 pivots, the sheet feeding cassette 60 moves to a predetermined mounting position (feeding position) in which feeding of the sheet can be performed by the pickup roller 75 while receiving the biasing force in the mounting direction from the tension spring 73 through the take-in arm 68.

Moreover, after the sheet feeding cassette 60 is moved to the predetermined mounting position, the intermediate plate provided in the sheet feeding cassette body 60A to be pivotable in a vertical direction is lifted and the sheet S on the intermediate plate comes in contact with the pickup roller 75. Thereafter, the pickup roller 75 and the feed roller 76 provided in the sheet feeding apparatus 30 rotate and thereby the sheet S is supplied to the image forming portion 1B.

However, as illustrated in FIG. 2, when mounting the sheet feeding cassette 60, a positioning portion 74 performing positioning of the sheet feeding cassette 60 in the mounting direction (depth direction) is provided in one end portion (right end portion) orthogonal to the mounting direction on an upstream side in the mounting direction of the sheet feeding cassette body 60A. The positioning portion 74 has a positioning member 74*a* that is provided in the sheet feeding cassette body 60A and performs positioning of the sheet feeding cassette 60 in the depth direction by abutting the body frame 79. Then, if the sheet feeding cassette 60 is mounted, the sheet feeding cassette is taken in by the take-in unit 66, positioning of the sheet feeding cassette 60 in the mounting direction is performed by the positioning portion 74, and the sheet feeding cassette 60 is positioned in the feed position in which feeding of the sheet can be performed.

Figure 3A:
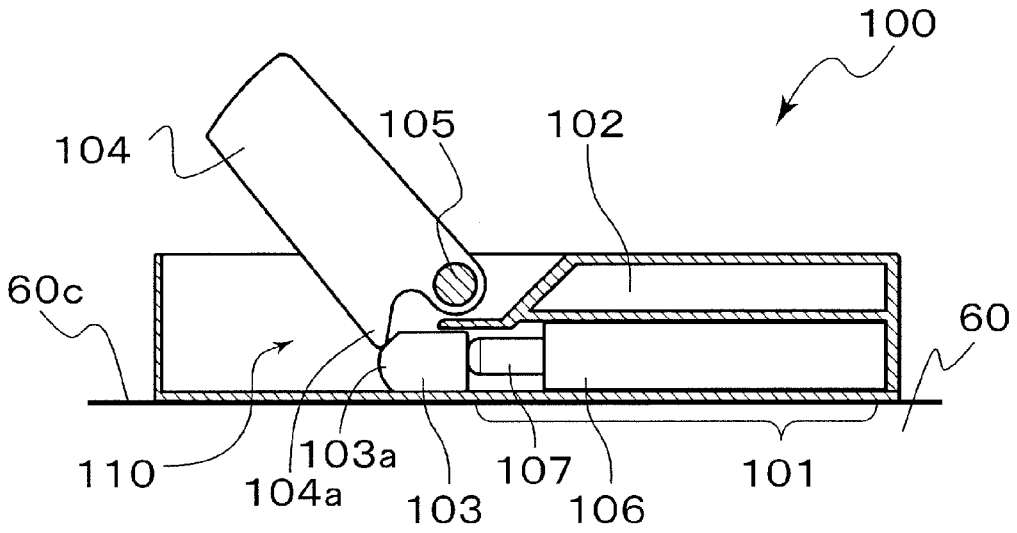
FIG. 3A is a plan cross-sectional view illustrating a damper unit in a state before inserting the sheet feeding cassette.
Figure 3B:
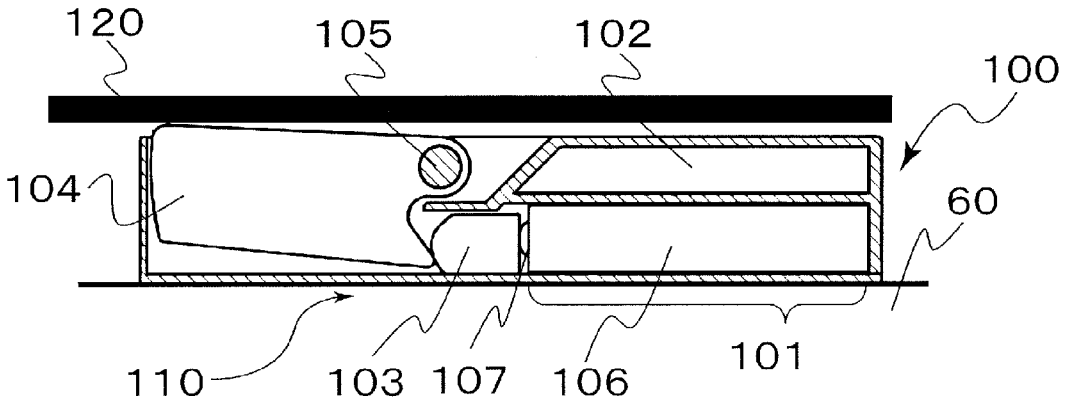
FIG. 3B is a plan cross-sectional view illustrating the damper unit in a state after inserting the sheet feeding cassette.

Furthermore, a damper unit 100 is mounted on the far side wall 60*c* of the sheet feeding cassette body 60A. The damper unit 100 is a resistance unit that applies the resistance force (braking force) against the sheet feeding cassette 60 and suppressing moving velocity of the sheet feeding cassette 60 while mounting the sheet feeding cassette 60. As illustrated in FIGS. 3A and 3B, the damper unit 100 includes a damper case 102 fixed to the far side wall 60*c* of the sheet feeding cassette body 60A and a linear type oil damper 101 housed in the damper case 102. Furthermore, the damper unit 100 includes a pivot type link 104 that is the link member and a transmitting member 103 provided between the pivot type link 104 and the linear type oil damper 101.

The linear type oil damper 101 includes an oil damper body 106 and a piston rod 107 that is provided in the oil damper body 106 and is capable of moving in a direction parallel to the far side wall 60*c* of the sheet feeding cassette body 60A. That is, the piston rod 107 is provided to be movable in an intersecting direction orthogonal to the direction of movement of the sheet feeding cassette 60. The linear type oil damper 101 is linearly retractably provided and generates the resistance force during expansion and contraction.

Here, linear expansion and contraction of the linear type oil damper 101 are referred to as a linear operation. Then, in the linear operation in which the piston rod 107 is pushed to the oil damper body 106, the resistance force (braking force) is generated on a side opposite to a pushing direction by oil inside the oil damper body 106. Here, in the linear type oil damper 101, the resistance force increases and decreases in accordance with an increase and decrease in a speed of the force used to push the piston rod 107. In the embodiment, the linear type oil damper 101 uses the resistance force generated, when the piston rod 107 enters into the oil damper body 106 and shrinks, as the braking force during insertion of the sheet feeding cassette 60.

The linear type oil damper 101 is mounted on the sheet feeding cassette body 60A such that a direction (expansion and contraction direction) in which the linear operation is performed is the direction intersecting the mounting direction of the sheet feeding cassette 60 on the printer body 1A. Furthermore, the transmitting member 103 is provided within the damper case 102 to be integrally movable by coming in contact with an end portion of the piston rod 107. The pivot type link 104 is supported to be pivotable by a pivotal shaft 105 that is the pivot center provided in the damper case 102 and is disposed so as to come in contact with the transmitting member 103.

Moreover, the pivot shaft 105 extends in a direction orthogonal to the intersecting direction that is the moving direction of the sheet feeding cassette 60 and the moving direction of the piston rod 107. Then, the transmitting member 103 performs a linear movement in accordance with the pivoting of the pivot type link 104, pushes the piston rod 107, and makes the linear type oil damper 101 generate the resistance force. The pivot type link 104 and the transmitting member 103 described above configure a transmitting mechanism 110 that transmits the motion of the sheet feeding cassette 60 moving in the direction toward the piston rod 107 as a motion in the intersecting direction.

Next, a braking operation of the damper unit 100 having such a configuration during insertion of the sheet feeding cassette 60 will be described. FIG. 3A illustrates a state before the sheet feeding cassette 60 is inserted into the printer body 1A and FIG. 3B illustrates a state after the sheet feeding cassette 60 is inserted into the printer body 1A. Moreover, in FIGS. 3A and 3B, the transmitting member 103 has a contact portion 103*a* that comes in contact with the pivot type link 104 and the pivot type link 104 has a protrusion portion 104*a* (contacted portion) that comes in contact with the transmitting member 103. The contact portion 103*a* is formed to be curved so as to protrude toward the protrusion portion 104*a*.

When inserting the sheet feeding cassette 60 into the printer body 1A, first, a contact portion 120 provided in the body frame 79 and the pivot type link 104 illustrated in FIG. 2 collide and the pivot type link 104 pivots in the counterclockwise direction about the pivotal shaft 105 as the pivot center. Then, the transmitting member 103 that comes in contact with the pivot type link 104 due to pivoting of the pivot type link 104 receives a force from the pivot type link 104 and performs the linear movement in a direction in which the piston rod 107 is pushed to the oil damper body 106. The linear type oil damper 101 receives the force in the direction in which the piston rod 107 is pushed in accordance with the operation. At this time, since the linear type oil damper 101 performs the linear motion and generates the resistance force, the sheet feeding cassette 60 receives the resistance force in a direction opposite to the insertion direction in the damper unit 100.

Here, in the embodiment, in order to generate the resistance force, the linear type oil damper 101 is used and the resistance force generated in the linear type oil damper 101 is generally proportional to the square of the pushing speed of the piston rod 107. That is, in the linear operation of the linear type oil damper 101, the resistance force that is proportional to the square of the insertion speed of the sheet feeding cassette 60 is generated.

If damper torque of the linear type oil damper 101 is used as the resistance force suppressing momentum of the sheet feeding cassette 60, the resistance force proportional to the insertion speed of the sheet feeding cassette 60 is generated. Meanwhile, for example, in the case of the rotary type oil damper using grease of the related art having a certain viscosity, generally, the damper torque is proportional to a rotation speed of a braked member. Thus, in the damper unit 100, as the embodiment, if the linear type oil damper is used, speed dependency of the resistance force is further increased compared to a case where the rotary oil damper is used.

Here, it is desired that the speed dependency of the resistance force acting in the direction opposite to the direction of insertion of the sheet feeding cassette 60 is increased. The speed dependency of the resistance force being increased means that a greater resistance force is generated as the insertion speed of the sheet feeding cassette 60 is increased. It is possible to cope with higher speed insertion of the sheet feeding cassette 60 by increasing the speed dependency of the resistance force. Thus, in the embodiment, the linear type oil damper 101 having high speed dependency of the resistance force is used.

However, if the resistance force is increased by the damper unit 100, it is necessary to increase a take-in force of the take-in unit 66 by which the sheet feeding cassette 60 is taken in while mounting the sheet feeding cassette 60. However, if the take-in force of the take-in unit 66 is great, the take-out force (operation force) while the sheet feeding cassette 60 is being drawn by the user is increased and operability is lowered.

On the other hand, in the case of the linear type oil damper 101 in which speed dependency of the resistance force is high, if insertion of the sheet feeding cassette 60 is slow, only very little resistance force is generated. As described above, if only very little resistance force is generated, it is possible to suppress the take-in force of the take-in unit 66 required to overcome the resistance force, to reduce a take-out force when the user takes the sheet feeding cassette 60 out, and to prevent a decrease in operability.

Thus, in the embodiment, the resistance force is reduced as the position of the sheet feeding cassette 60 in the direction of insertion becomes closer to the feed position. Specifically, as the sheet feeding cassette 60 becomes closer to the feed position, the force pressing the transmitting member 103 is reduced by the pivot type link 104. Thus, it is possible to exert a greater resistance force for insertion of the sheet feeding cassette 60 at high speed while suppressing an increase in the operation force using such a configuration.

Figure 4A:
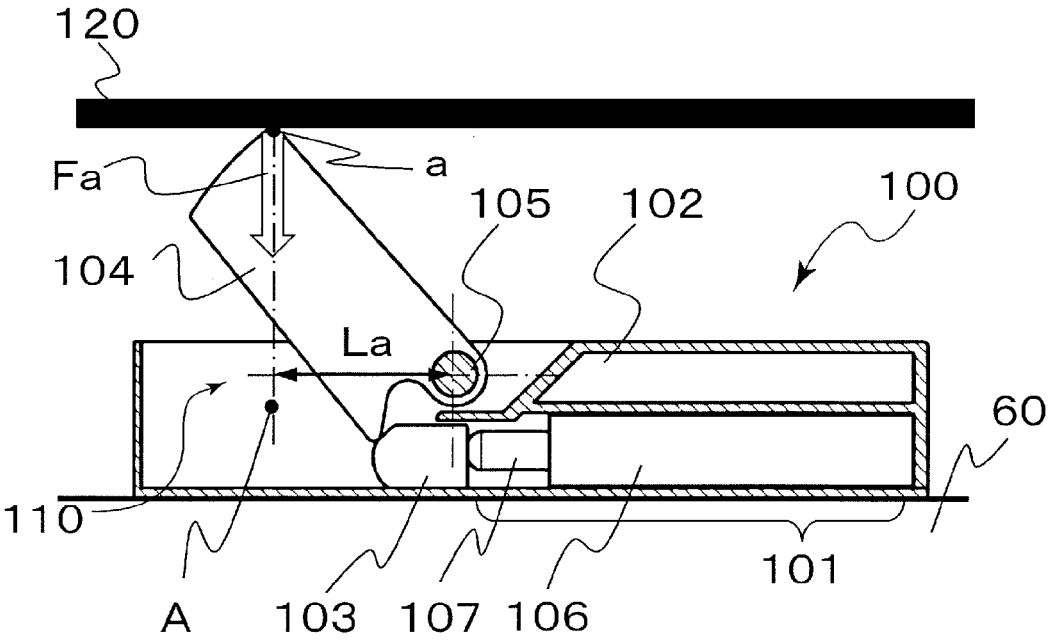
FIG. 4A is a plan cross-sectional view illustrating the damper unit during an initial stage of generation of a resistance force.
Figure 4B:
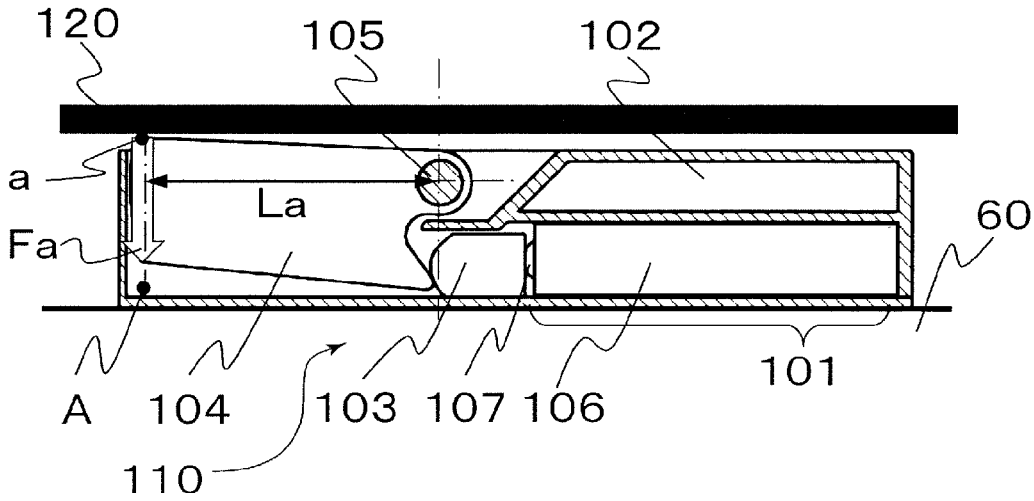
FIG. 4B is a plan cross-sectional view illustrating the damper unit in a state where the sheet feeding cassette is mounted.
Figure 5A:
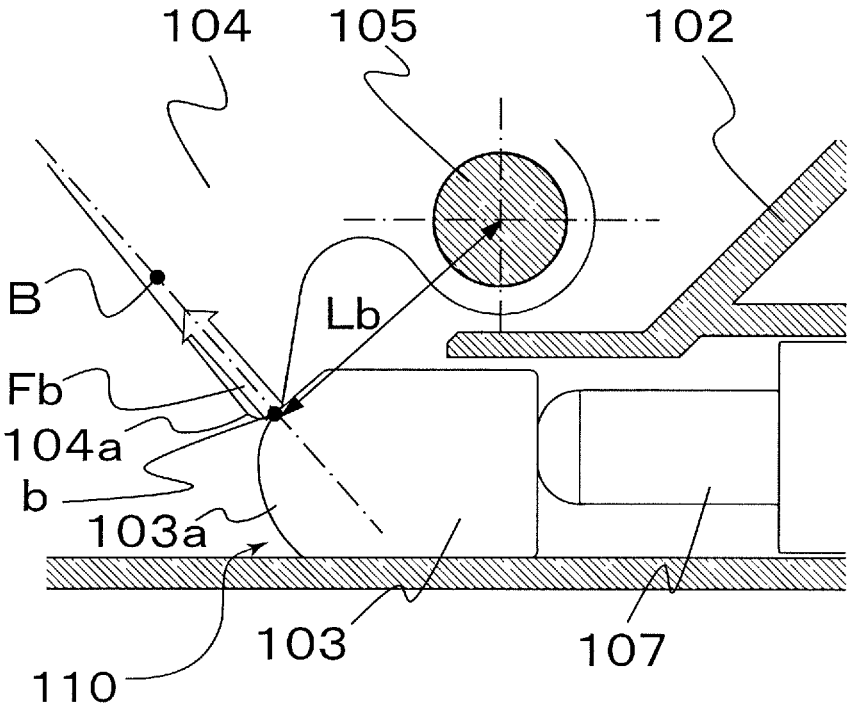
FIG. 5A is an enlarged cross-sectional view illustrating a pivot type link and a contact portion of a transmitting member during the initial stage of generation of the resistance force.
Figure 5B:
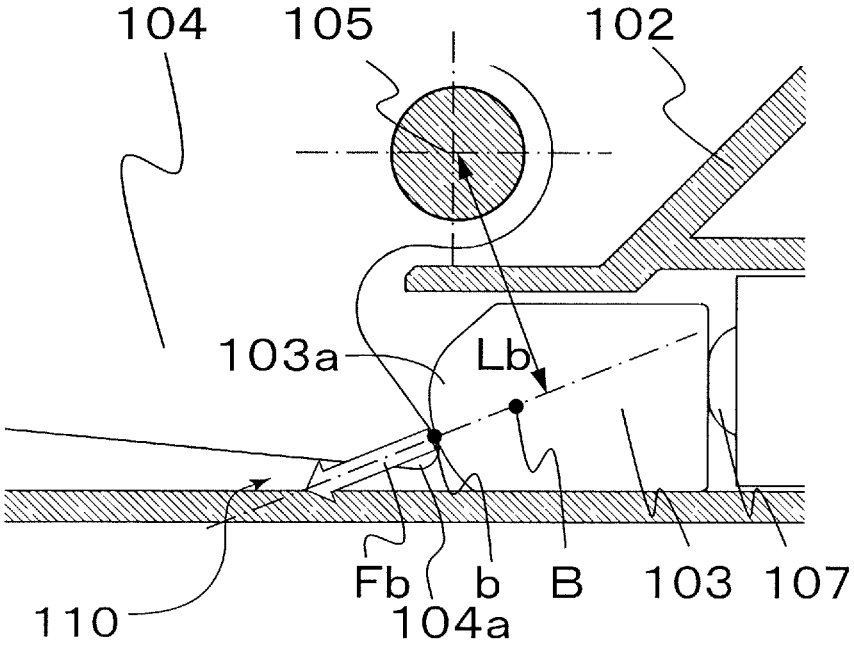
FIG. 5B is an enlarged cross-sectional view illustrating the pivot type link and the contact portion of the transmitting member in a state where the sheet feeding cassette is mounted.

Next, a size of the resistance force depending on the position of the sheet feeding cassette 60 in the mounting direction will be described with reference to FIGS. 4A to 5B. FIG. 4A illustrates a state of the damper unit 100 in an initial stage of generation of the resistance force, that is, an initial mounting stage when the pivot type link 104 comes in contact with the contact portion 120 of the body frame 79. FIG. 4B illustrates a state of the damper unit 100 where the sheet feeding cassette 60 is mounted. Furthermore, FIG. 5A illustrates a state in the vicinity of the contact portion of the pivot type link 104 and the transmitting member 103 during the initial stage of generation of the resistance force. FIG. 5B illustrates a state of the vicinity of the contact portion of the pivot type link 104 and the transmitting member 103 in a state where the sheet feeding cassette 60 is mounted. Moreover, the sheet feeding cassette 60 is positioned in the feed position in FIGS. 4A and 5A, and is positioned in a start position to start receiving the resistance force from the damper unit 100 in FIGS. 4B and 5B.

Moreover, in FIGS. 4A and 4B, symbol a is a contact point between the pivot type link 104 and the contact portion 120 of the body frame 79, symbol A is a normal line in the contact point a (contact surface) between the pivot type link 104 and the contact portion 120, and symbol La is a distance (first distance) between the pivotal shaft 105 and the normal line A. Symbol Fa is a force that is received by the pivot type link 104 from the contact portion 120 in a direction of the normal line A. In FIGS. 5A and 5B, symbol b is a contact point between the pivot type link 104 and the contact portion 103*a* of the transmitting member 103, symbol B is a normal line in the contact point b (contact surface) between the pivot type link 104 and the transmitting member 103, and symbol Lb is a distance (second distance) between the pivotal shaft 105 and the normal line B. Symbol Fb is a force that is received by the pivot type link 104 from the transmitting member 103 in a direction of the normal line B.

Figure 6:
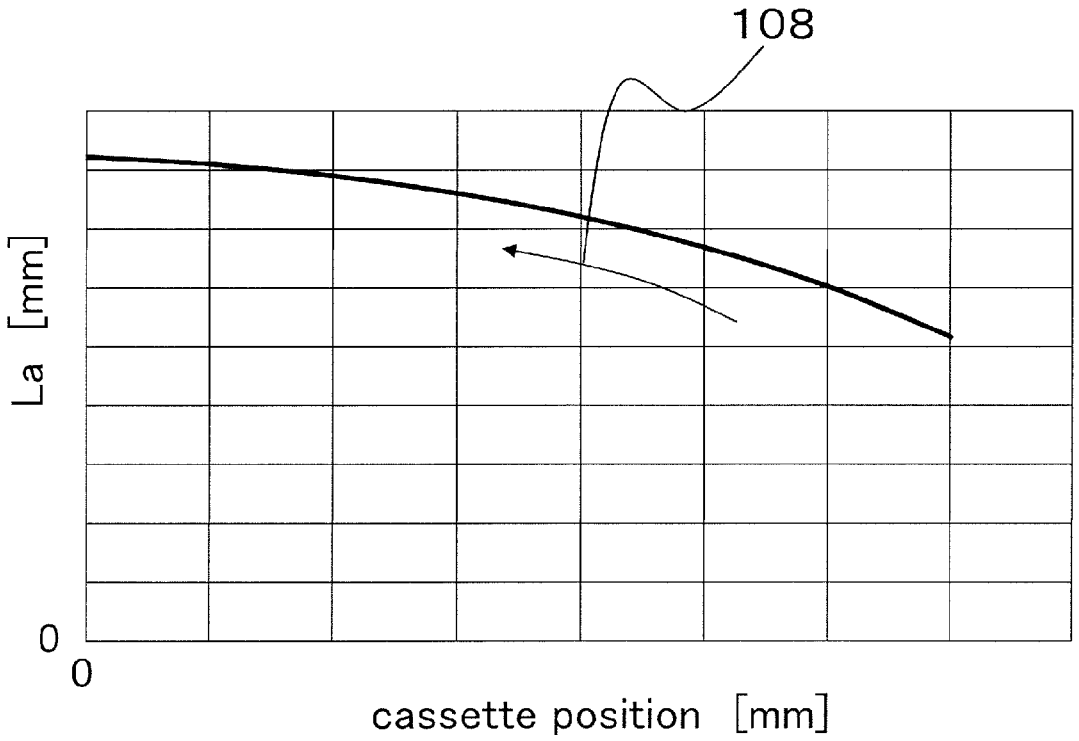
FIG. 6 is a view illustrating a change in a first distance La of the damper unit in accordance with cassette insertion.

Then, as illustrated in FIG. 4A, the sheet feeding cassette 60 is inserted and the pivot type link 104 comes in contact with the contact portion 120. Thereafter, if the sheet feeding cassette 60 is inserted further, as illustrated in FIG. 4B, the contact point a gradually moves to the left side in the view provided. A change in the first distance La in accordance with the insertion of the sheet feeding cassette 60 is indicated in a graph in FIG. 6. Moreover, in FIG. 6, point 0 of a horizontal axis indicates the feed position of the cassette, and an arrow 108 indicates a direction in which the position of the sheet feeding cassette 60 is changed in accordance with the insertion of the sheet feeding cassette 60.

As described above, if the sheet feeding cassette is inserted from the start position toward the feed position, the first distance La becomes gradually longer and an amount by which the piston rod 107 of the linear type oil damper 101 moves with respect to unit moving amount of the sheet feeding cassette 60 is reduced. Thus, the speed of the linear type oil damper 101 is reduced and the resistance force generated in the linear type oil damper 101 is reduced during the linear operation.

Figure 7:
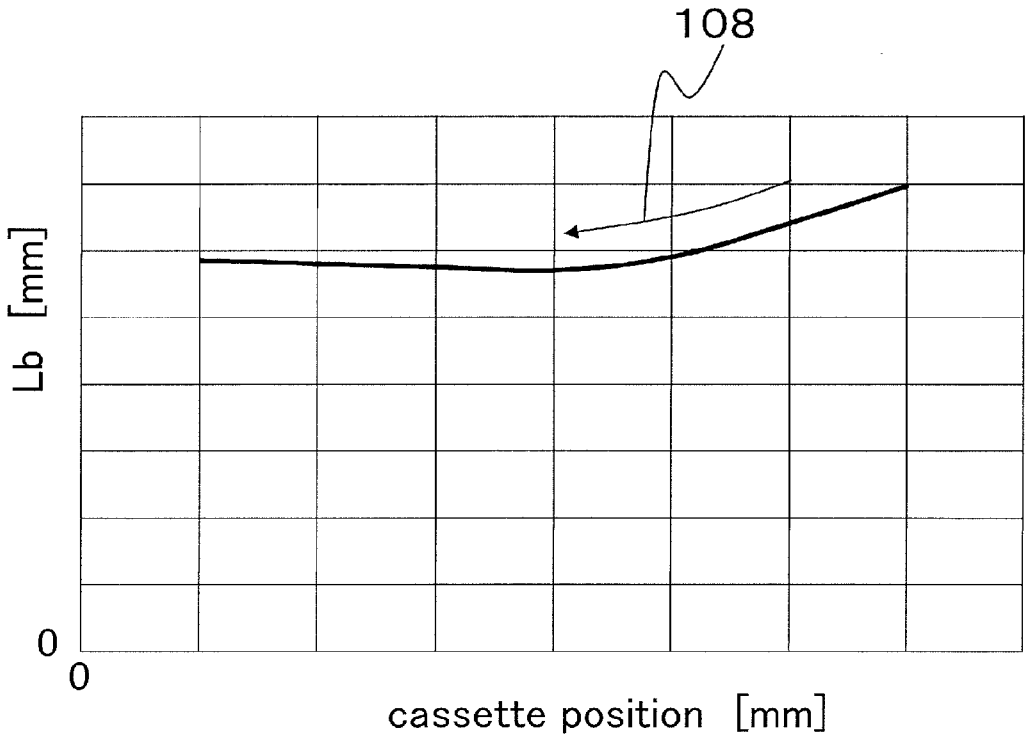
FIG. 7 is a view illustrating a change in a second distance Lb of the damper unit in accordance with cassette insertion.

On the other hand, as the sheet feeding cassette 60 approaches the feed position illustrated in FIG. 5B from the start position illustrated in FIG. 5A, the contact point b moves downward along the contact portion 103*a* of the transmitting member 103. Here, as illustrated in FIGS. 5A and 5B, the contact portion 103*a* of the transmitting member 103 that comes in contact with the protrusion portion 104*a* of the pivot type link 104 is curved. Thus, when the pivot type link 104 pivots, the second distance Lb becomes gradually shorter. A change in the second distance Lb in accordance with the insertion of the sheet feeding cassette 60 is illustrated in a graph in FIG. 7. As described above, it is possible to shorten the second distance Lb in the mounting state of the sheet feeding cassette 60 illustrated in FIG. 5B more than in the initial stage of the generation of the resistance force illustrated in FIG. 5A by configuring the contact portion 103*a* and the protrusion portion 104*a*. A moment of a force Fb is reduced by shortening the second distance Lb and thereby it is possible to reduce the braking force (resistance force) acting on the sheet feeding cassette 60 through the pivot type link 104.

Figure 8:
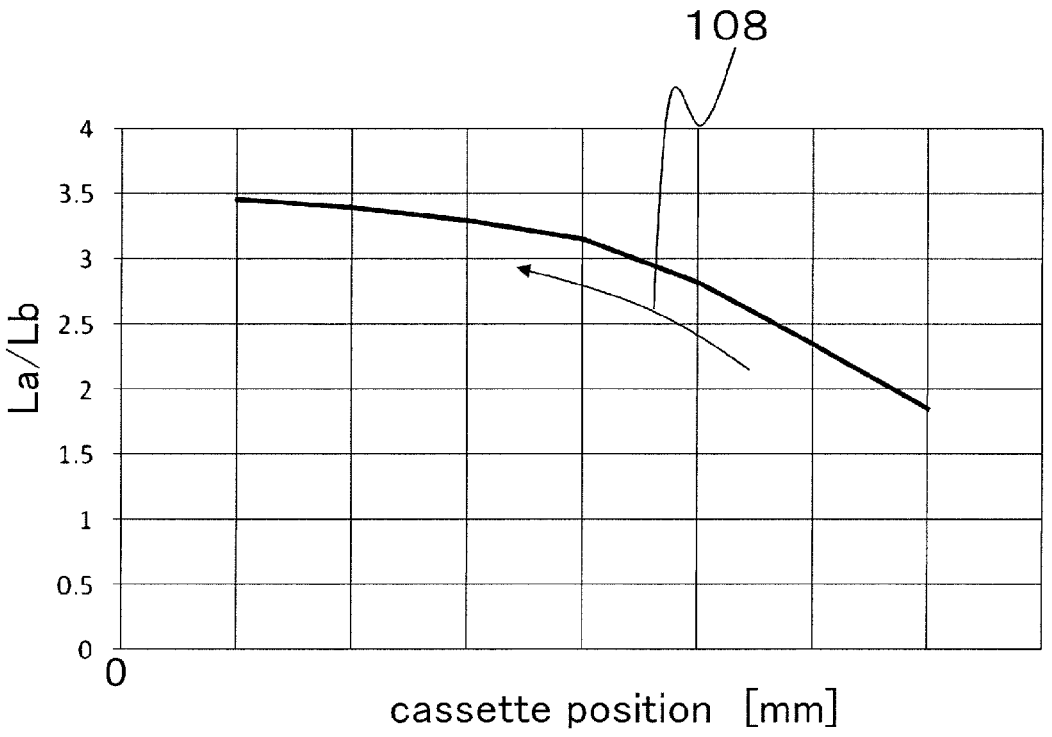
FIG. 8 is a view illustrating a change in La/Lb of the damper unit in accordance with cassette insertion.
Figure 9:
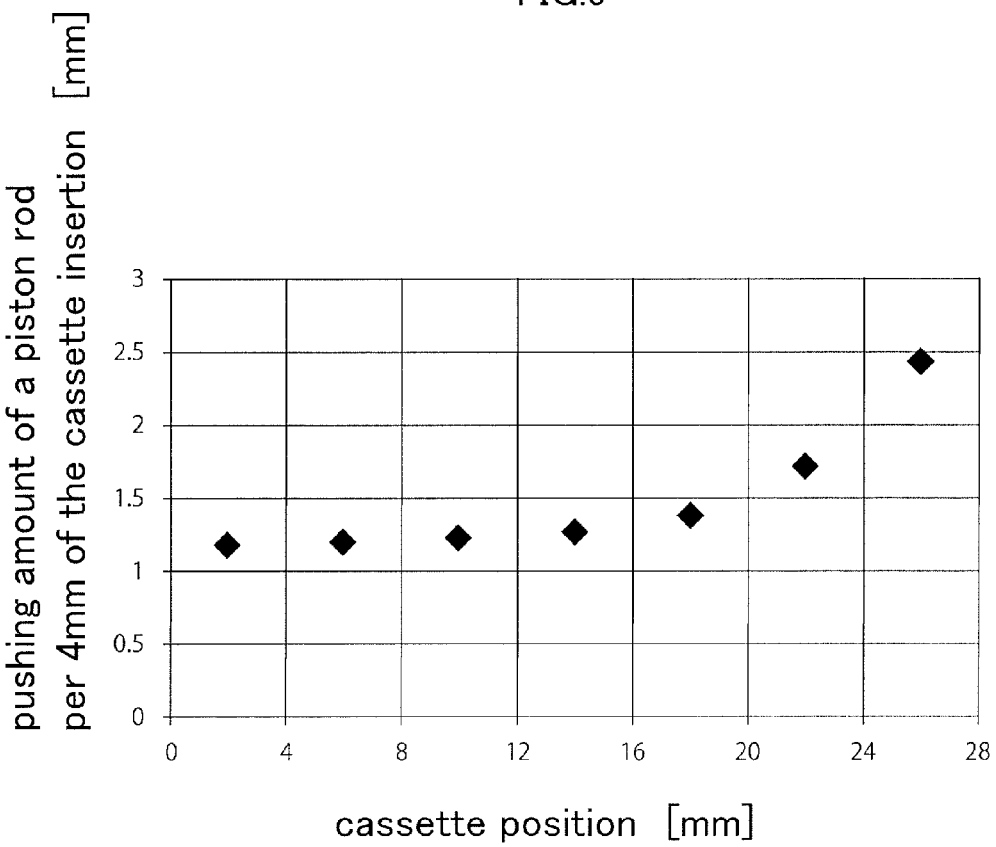
FIG. 9 is a view illustrating a change in a pushing amount of a piston rod of the damper unit in accordance with cassette insertion.

The first distance La becomes longer and the second distance Lb becomes shorter in accordance with the insertion of the sheet feeding cassette 60, and thereby (first distance) La/(second distance) Lb is gradually increased as illustrated in FIG. 8. FIG. 9 illustrates an example of an amount by which the piston rod 107 is pushed per an insertion distance of the sheet feeding cassette 60 in a case where each parameter is set such that (first distance) La/(second distance) Lb is changed as illustrated in FIG. 8. Moreover, FIG. 9 illustrates the distance by which the piston rod 107 is pushed whenever the sheet feeding cassette 60 is inserted 4 mm.

That is, when the inserted sheet feeding cassette moves for example, from a position of 28 mm to a position of 24 mm with respect to the feed position in the initial stage of the generation of the resistance force, the amount (moving amount) by which the piston rod 107 is pushed is 2.4 mm. On the other hand, when the sheet feeding cassette 60 moves from a position of 4 mm with respect to the feed position to the feed position, the amount (moving amount) by which the piston rod 107 is pushed is 1.2 mm.

That is, the amount by which the piston rod 107 is pushed in the initial stage of the generation of the resistance force is twice the amount by which the piston rod 107 is pushed when the sheet feeding cassette 60 reaches the feed position from the position close to the feed position. As described above, even if the moving velocities of the sheet feeding cassette 60 are the same, in the initial stage of the generation of the resistance force, the piston rod 107 is pushed with twice as much force, that is, with a speed twice as fast immediately before the sheet feeding cassette 60 is mounted in the feed position.

Here, as described above, the resistance force of the linear type oil damper 101 depends on the insertion speed of the sheet feeding cassette 60. Thus, as the embodiment, it is possible to generate a great resistance force by disposing the transmitting member 103 and the pivot type link 104 when the position of the sheet feeding cassette 60 is on the near side of the body, that is, when the sheet feeding cassette 60 is in the initial stage of mounting.

As described above, in the embodiment, as the damper unit 100, the linear type oil damper 101 in which the speed dependency of the resistance force is increased is used. Furthermore, the transmitting member 103 and the pivot type link 104 are disposed such that the sheet feeding cassette 60 is significantly decelerated during the initial stage of the generation of the resistance force. Thus, sufficient deceleration can be achieved while suppressing the operation force of the user even if the insertion of the sheet feeding cassette is performed at high speed. That is, as the embodiment, while mounting the sheet feeding cassette 60, a great resistance force is applied to the sheet feeding cassette 60 by the damper unit 100 during the initial stage of mounting and thereby it is possible to reduce impact while mounting the sheet feeding cassette 60 and to prevent reduction of the operability thereof.

Furthermore, in the embodiment, the linear type oil damper 101 is disposed such that the direction (expansion and contraction direction, intersecting direction) in which the linear operation is performed is the direction intersecting (including orthogonal) the mounting direction (direction of movement)

of the sheet feeding cassette 60 into the printer body 1A. It is possible to reduce the entire size of an apparatus by using such an arrangement compared to a case where the direction in which the linear operation of the linear type oil damper 101 which is performed is parallel to the mounting direction of the sheet feeding cassette 60 to the printer body 1A. Moreover, in the embodiment, the transmitting mechanism 110 is constituted of the pivot type link 104 and the transmitting member 103, but this disclosure is not limited to the embodiment. For example, the transmitting mechanism 110 may be constituted of an L-type hydraulic mechanism, a cam mechanism formed of a cam groove and a cam follower, or a rack and pinion mechanism having two racks orthogonal to each other, and the like.

Figure 10A:
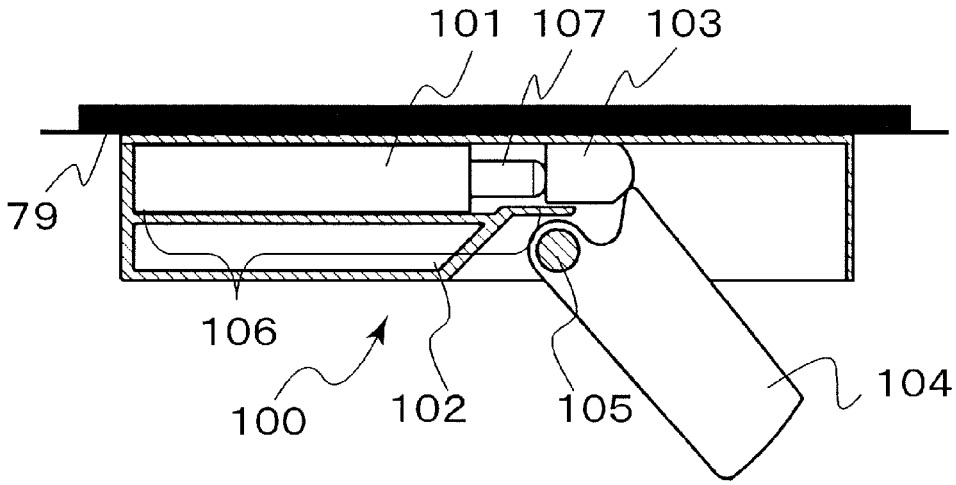
FIG. 10A is a plan cross-sectional view illustrating another configuration of the damper unit during the initial stage of the generation of the resistance force.
Figure 10B:
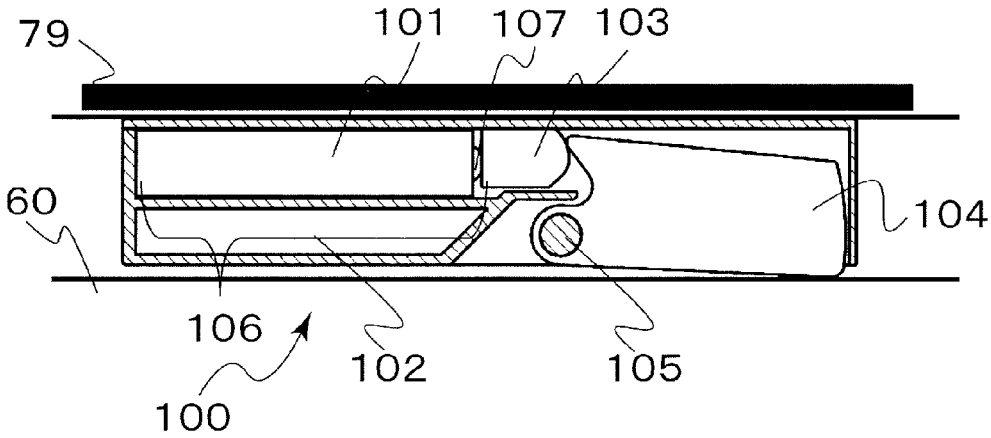
FIG. 10B is a plan cross-sectional view illustrating another configuration of the damper unit in a state where the sheet feeding cassette is mounted.

Moreover, in the above description, the damper unit 100 is provided in the sheet feeding cassette 60 that is one of the sheet feeding cassette 60 and the printer body 1A, but this disclosure is not limited to the embodiment. For example, as illustrated in FIGS. 10A and 10B, the damper unit 100 may be fixed to the other of the sheet feeding cassette 60 and the printer body 1A, that is, to the body frame 79. In this case, while inserting the sheet feeding cassette 60, the damper unit 100 comes in contact with the sheet feeding cassette 60. Moreover, FIG. 10A illustrates a state before the sheet feeding cassette 60 is inserted and FIG. 10B illustrates the mounting state of the sheet feeding cassette 60. Also in this configuration, it is possible to achieve the effects of this disclosure.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-089065, filed on Apr. 23, 2014, and Japanese Patent Application No. 2015-078413, filed on Apr. 7, 2015, which are hereby incorporated by reference herein in their entirety.

What is claimed is:

1. A sheet feeding apparatus comprising:

an apparatus body;

a sheet feed portion feeding a sheet;

a sheet storage portion in which sheets fed by the sheet feed portion are stored and which is provided in the apparatus body to be capable of being mounted and drawn; and a resistance unit that is provided on one of the sheet storage portion and the apparatus body, and applies a resistance force against the sheet storage portion while the sheet storage portion is being mounted toward a feed position to which the sheet is capable of being fed by the sheet feed portion, the resistance unit including:

a link member that is pivoted by coming in contact with the other of the sheet storage portion and the apparatus body while the sheet storage portion is being mounted on the apparatus body toward the feed position, and is formed such that a distance between a normal line in an contact surface with the other of the sheet storage portion and the apparatus body and a pivot center becomes longer as the sheet storage portion approaches the feed position;

a linear type oil damper generating the resistance force through a linear operation in accordance with the pivoting of the link member; and a transmitting member that is provided between the link member and the linear type oil damper, linearly moves due to the pivoting of the link member, and transmits the pivoting of the link member to the linear type oil damper.

2. The sheet feeding apparatus according to claim 1, wherein the transmitting member includes a contact portion that comes in contact with the link member, wherein the link member includes a contacted portion that comes in contact with the transmitting member, and wherein the contact portion and the contacted portion are formed such that a distance between the normal line, in a contact surface between the contact portion and the contacted portion, and the pivot center of the link member becomes shorter as the sheet storage portion approaches the feed position.

3. The sheet feeding apparatus according to claim 2, wherein the contact portion is formed to be curved so as to protrude toward the contacted portion.

4. The sheet feeding apparatus according to claim 1, wherein a direction in which the linear type oil damper is linearly operated is a direction intersecting a mounting direction of the sheet storage portion.

5. The sheet feeding apparatus according to claim 1, wherein in the linear type oil damper, the resistance force is increased or decreased depending on an increase or decrease in a speed of the linear operation.

6. The sheet feeding apparatus according to claim 1, further comprising a take-in unit taking the sheet storage portion inserted into a predetermined position of the apparatus body into the feed position, wherein the linear type oil damper generates the resistance force by pivoting the link member while the sheet storage portion is being taken in by the take-in unit.

7. The sheet feeding apparatus according to claim 6, wherein the take-in unit includes a biasing member biasing the sheet storage portion from the predetermined position to the feed position when the sheet storage portion is mounted on the apparatus body and biasing the sheet storage portion from the predetermined position toward an opposite direction to the feed position while the sheet storage portion is being drawn.

8. A sheet feeding apparatus comprising:

an apparatus body;

a sheet feed portion feeding a sheet;

a sheet storage portion in which sheets fed by the sheet feed portion are stored and which is provided in the apparatus body to be capable of being mounted and drawn; and a resistance unit applying a resistance force to the sheet storage portion while the sheet storage portion is being mounted toward a feed position to which the sheet is capable of being fed by the sheet feed portion, the resistance unit including:

a linear type oil damper that has a piston rod capable of moving in an intersecting direction intersecting a direction of movement of the sheet storage portion and generates the resistance force by movement of the piston rod in the intersecting direction while the sheet storage portion is being mounted toward the feed position, and a transmitting mechanism that is provided between the sheet storage portion and the piston rod and transmits a movement, in the direction of movement, of the sheet storage portion to the piston rod as a movement in the intersecting direction, the transmitting mechanism reducing a moving amount of the piston rod in the intersecting direction with respect to unit movement amount in the direction of movement of the sheet storage portion as the sheet storage portion a roaches the feed position from a start position in which the sheet storage portion starts to receive the resistance force.

9. The sheet feeding apparatus according to claim 8, wherein the resistance unit is provided on one of the sheet storage portion and the apparatus body, and wherein the transmitting mechanism includes a link member that pivots about a pivotal shaft extending in a direction orthogonal to the movement and an intersecting direction, the link member being rotated by coming in contact with the other of the sheet storage portion and the apparatus body while the sheet storage portion is being mounted toward the feed position, and being formed such that a distance between a normal line, in an contact surface with the other of the sheet storage portion and the apparatus body, and the pivotal shaft becomes longer as the sheet storage portion approaches the feed position from the start position.

10. The sheet feeding apparatus according to claim 9, wherein the transmitting mechanism includes a transmitting member that is provided between the link member and the piston rod, and is moved in the intersecting direction by pivoting of the link member, wherein the transmitting member includes a contact portion that comes in contact with the link member, wherein the link member includes a contacted portion that comes in contact with the transmitting member, and wherein the contact portion and the contacted portion are formed such that a distance between a normal line, in a contact surface between the contact portion and the contacted portion, and the pivotal shaft of the link member becomes shorter as the sheet storage portion approaches the feed position from the start position.

11. The sheet feeding apparatus according to claim 10, wherein the contact portion is formed to be curved so as to protrude toward the contacted portion.

12. The sheet feeding apparatus according to claim 8, wherein in the linear type oil damper, the resistance force is increased or decreased depending on an increase or decrease in a speed of the piston rod in the intersecting direction.

13. The sheet feeding apparatus according to claim 8, further comprising a take-in unit taking the sheet storage portion inserted into a predetermined position of the apparatus body into the feed position, wherein the resistance unit generates the resistance force when the sheet storage portion is taken in by the take-in unit.

14. The sheet feeding apparatus according to claim 13, wherein the predetermined position is a position between the start position and the feed position, and wherein the take-in unit includes a biasing member biasing the sheet storage portion from the predetermined position toward the feed position while the sheet storage portion is being mounted on the apparatus body and biasing the sheet storage portion from the predetermined position toward the start position while the sheet storage portion is being drawn.

15. The sheet feeding apparatus according to claim 8, wherein the resistance unit is provided in the sheet storage portion and comes in contact with the apparatus body while the sheet storage portion is being mounted toward the feed position from the start position.

16. An image forming apparatus comprising:

an image forming portion forming an image on a sheet; and a sheet feeding apparatus feeding the sheet to the image forming portion, the sheet feeding apparatus comprising:

an apparatus body;

a sheet feed portion feeding a sheet;

a sheet storage portion in which sheets fed by the sheet feed portion are stored and which is provided in the apparatus body to be capable of being mounted and drawn; and a resistance unit that is provided on one of the sheet storage portion and the apparatus body, and applies a resistance force against the sheet storage portion while the sheet storage portion is being mounted toward a feed position to which the sheet is capable of being fed by the sheet feed portion, the resistance unit including:

a link member that is pivoted by coming in contact with the other of the sheet storage portion and the apparatus body while the sheet storage portion is being mounted on the apparatus body toward the feed position, and is formed such that a distance between a normal line in a contact surface with the other of the sheet storage portion and the apparatus body and a pivot center becomes longer as the sheet storage portion approaches the feed position;

a linear type oil damper generating the resistance force through a linear operation in accordance with the pivoting of the link member; and a transmitting member that is provided between the link member and the linear type oil damper, linearly moves due to the pivoting of the link member, and transmits the pivoting of the link member to the linear type oil damper.

17. An image forming apparatus comprising:

an image forming portion forming an image on a sheet; and a sheet feeding apparatus feeding the sheet to the image forming portion, the sheet feeding apparatus comprising:

an apparatus body;

a sheet feed portion feeding a sheet;

a sheet storage portion in which sheets fed by the sheet feed portion are stored and which is provided in the apparatus body to be capable of being mounted and drawn; and a resistance unit applying a resistance force to the sheet storage portion while the sheet storage portion is being mounted toward a feed position to which the sheet is capable of being fed by the sheet feed portion, the resistance unit including:

a linear type oil damper that has a piston rod capable of moving in an intersecting direction intersecting a direction of movement of the sheet storage portion and generates the resistance force by movement of the piston rod in the intersecting direction while the sheet storage portion is being mounted toward the feed position, and a transmitting mechanism that is provided between the sheet storage portion and the piston rod and transmits a movement, in the direction of movement, of the sheet storage portion to the piston rod as a movement in the intersecting direction, the transmitting mechanism reducing a moving amount of the piston rod in the intersecting direction with respect to unit moving amount in the direction of movement of the sheet storage portion as the sheet storage portion approaches the feed position from a start position in which the sheet storage portion starts to receive the resistance force.

18. The sheet feeding apparatus comprising:

an apparatus body;

a sheet feed portion feeding a sheet;

a sheet storage portion in which sheets fed by the sheet feed portion are stored and which is provided in the apparatus body to be capable of being mounted and drawn; and a resistance unit applying a resistance force to the sheet storage portion while the sheet storage portion is being mounted toward a feed position to which the sheet is capable of being fed by the sheet feed portion, the resistance unit including:

a linear type damper that has a piston rod capable of moving in an intersecting direction intersecting a direction of movement of the sheet storage portion and generates the resistance force by movement of the piston rod in the intersecting direction while the sheet storage portion is being mounted toward the feed position, and a transmitting mechanism that is provided between the sheet storage portion and the piston rod and transmits a movement, in the direction of movement, of the sheet storage portion to the piston rod as a movement in the intersecting direction, the transmitting mechanism being configured such that a first moving amount of the piston rod is greater than a second moving mount of the piston rod, wherein the first moving amount of the piston rod is a moving amount of the piston rod in the intersecting direction, with respect to unit moving amount in the direction of movement of the sheet storage portion, in a case where the sheet storage portion moves from a first position to a second position closer to the feed position than the first position, and the second moving amount of the piston rod is a moving amount of the piston rod in the intersecting direction, with respect to unit moving amount in the direction of movement of the sheet storage portion, in a case where the sheet storage portion moves from the second position to a third position closer to the feed position than the second position.

19. The sheet feeding apparatus according to claim 18, further comprising a take-in unit taking the sheet storage portion inserted into a predetermined position of the apparatus body into the feed position, wherein the resistance unit generates the resistance force when the sheet storage portion is taken in by the take-in unit.

20. An image forming apparatus comprising:

an image forming portion forming an image on a sheet; and a sheet feeding apparatus feeding the sheet to the image forming portion, the sheet feeding apparatus comprising:

an apparatus body;

a sheet feed portion feeding a sheet;

a sheet storage portion in which sheets fed by the sheet feed portion are stored and which is provided in the apparatus body to be capable of being mounted and drawn; and a resistance unit applying a resistance force to the sheet storage portion while the sheet storage portion is being mounted toward a feed position to which the sheet is capable of being fed by the sheet feed portion, the resistance unit including:

a linear type damper that has a piston rod capable of moving in an intersecting direction intersecting a direction of movement of the sheet storage portion and generates the resistance force by movement of the piston rod in the intersecting direction while the sheet storage portion is being mounted toward the feed position, and a transmitting mechanism that is provided between the sheet storage portion and the piston rod and transmits a movement, in the direction of movement, of the sheet storage portion to the piston rod as a movement in the intersecting direction, the transmitting mechanism being configured such that a first moving amount for the piston rod is greater than a second moving amount of the piston rod, wherein the first moving amount of the piston rod is a moving amount of the piston rod in the intersecting direction, with respect to unit moving amount in the direction of movement of the sheet storage portion, in a case where the sheet storage portion moves from a first position to a second position closer to the feed position than the first position, and the second moving amount of the piston rod is a moving amount of the piston rod in the intersecting direction, with respect to unit moving amount in the direction of movement of the sheet storage portion, in a case where the sheet storage portion moves from the second position to a third position closer to the feed position than the second position.

* * * * *